United States Patent [19]

Endo et al.

[11] Patent Number: 4,954,406

[45] Date of Patent: Sep. 4, 1990

[54] ELECTROPHOTOGRAPHIC PLATE INCLUDING AN UNDERCOATING LAYER HAVING A SMOOTH SURFACE

[75] Inventors: Keiichi Endo; Yasushi Shinbo; Akira Kageyama; Yasuo Katsuya; Chihiro Kato; Masato Fukasawa; Makoto Sekine, all of Hitachi, Japan

[73] Assignee: Hitachi Chemical Company, Ltd., Tokyo, Japan

[21] Appl. No.: 265,557

[22] Filed: Nov. 1, 1988

[30] Foreign Application Priority Data

Nov. 2, 1987 [JP] Japan ..... 62-277737

[51] Int. Cl.[5] ..... G03G 5/14

[52] U.S. Cl. ..... 430/60; 430/62; 430/64; 430/131

[58] Field of Search ..... 430/60, 62, 64, 131

[56] References Cited

U.S. PATENT DOCUMENTS 3,364,079 1/1972 Champ et al. ..... 430/62 X 4,495,263 1/1985 VanderValk ..... 430/60

*Primary Examiner*—Paul R. Michl

*Assistant Examiner*—Jeffrey A. Lindeman

*Attorney, Agent, or Firm*—Antonelli, Terry, Stout & Kraus

[57] ABSTRACT

In an electrophotographic plate, that having an undercoating layer with smooth surface when observed by using a scanning electron microscope and an electric conductivity of at least $2\times10^{-14}\,\Omega^{-1}\cdot cm^{-1}$ between an electroconductive substrate and a photosensitive layer is improved in electrophotographic properties which are hardly changed by changes of circumstances.

7 Claims, 2 Drawing Sheets

ELECTROPHOTOGRAPHIC PLATE INCLUDING AN UNDERCOATING LAYER HAVING A SMOOTH SURFACE

BACKGROUND OF THE INVENTION

This invention relates to an electrophotographic plate.

In electrophotographic materials using photoconductive substances as a photosensitive material, there have mainly been used inorganic photoconductive substances such as selenium, zinc oxide, titanium oxide, cadmium oxide, etc. But some of them have strong toxicity, which results in causing a problem of disposal.

On the other hand, photosensitive materials using organic photoconductive compounds are generally weak in toxicity and advantageous in transparency, flexibility, lightweight properties, surface smoothness, price, and the like compared with the inorganic photoconductive substances. Thus, the organic photoconductive materials have widely been studied recently. Among them, complex type electrophotographic plates having separate charge generating function and charge transport function, that is, electrophotographic plates comprising a charge generating layer and a charge transport layer laminated on an electroconductive substrate, have been developed rapidly, since sensitivity can be remarkably improved compared with known electrophotographic plates using organic photoconductive compounds.

When a photosensitive layer is directly formed on an electroconductive substrate, particularly when the photosensitive layer comprises a charge generating layer and a charge transport layer and the charge generating layer is directly contact with the electroconductive substrate, cissings and unevenness are produced due to surface defects such as slight relief, scratches, stains, deposits and the like formed on the electroconductive substrate surface, which results in easily making the film thickness of the charge generating layer non-uniform. Thus, when such a complex type electrophotographic plate is applied to an electrophotographic device using, for example, the Carlson method and printed, there often arises a problem in that such surface defects appear on images formed as they are, for example, to produce black stains (small black points having a diameter of 200 μm or less) on the whole white background or white stains (white unprinted points having a diameter of 200 μm or less) on the whole black background, which results in lowering the image quality.

In order to solve such a problem, it is proposed to form a resin layer between the charge generating layer and the electroconductive substrate (that is, on the surface of the electroconductive substrate) in order to cover defects, stains, deposits, etc., on the surface of the electroconductive substrate and to make the charge generating layer uniform in thickness. Such a resin layer is generally called as an undercoating layer or an intermediate layer.

As the undercoating layer or intermediate layer, there are proposed to use layers make from resins such as polyamide resins, polyurethane resins, polyvinyl butyral resins, melamine resins, casein, phenol resins, epoxy resins, ethylene-vinyl acetate copolymer resins, ethylene-acryliric acid copolymer resins, etc., or to use resin layers containing electroconductive substances such as electroconductive metallic powders and metal complexes (e.g. Japanese Patent Unexamined Publication Nos. 61-110153, 61-163346, 61-20049, 61-204640, 61-204641, 61-240247, 61-254951, 61-258258, etc.).

Even if the undercoating layer is formed between the charge generating layer and the electro-conductive substrate, printing defects such as black stains and white stains are reduced to some extent at room temperature, but not removed completely. When the printing circumstances are at 30° C. or higher, particularly at 35° C. or higher, the black stains and white stains are increased to remarkably lower printing quality. This still retains a problem in that there can only be obtained unstable electrophotographic plates having a large change in printing quality.

SUMMARY OF THE INVENTION

It is an object of the present invention to provide an electrophotographic plate overcoming the defects as mentioned above.

The present invention provides an electrophotographic plate comprising an electroconductive substrate, an undercoating layer formed on the substrate, and a photosensitive layer formed on the undercoating layer, said undercoating layer having a smooth surface when observed by a scanning electron microscope and an electric conductivity of at least $2\times10^{-14}\,\Omega^{-1}\cdot cm^{-1}$.

DESCRIPTION OF THE PREFERRED EMBODIMENTS

As the electroconductive substrate, there can be used a sheet of paper or plastic film subjected to electroconducting treatment, a plastic film laminating a metallic foil such as aluminum foil, a metal plate, a metal drum, and the like.

The undercoating layer includes a thermoplastic resin or a thermosetting resin.

As the thermoplastic resin, there can be used polyamide resins, polyvinyl butyral resins, ethylenevinyl acetate copolymer resins, ethylene-acrylic acid copolymer resins, casein, etc.

The undercoating layer of the present invention should have a smooth surface when observed by a scanning electron microscope. The state of "smooth surface" means that the surface of undercoating layer is uniform without showing fibril-like (in fiber form) and crystalline unevenness when observed by using a scanning electron microscope, for example, with a magnification of 20,000 to 70,000 times and charged voltage of 2 to 15 kV in a perpendicular direction against the undercoating layer surface (i.e. from the top) after the formation of the undercoating layer and before the formation of a photosensitive layer.

Figure 1:
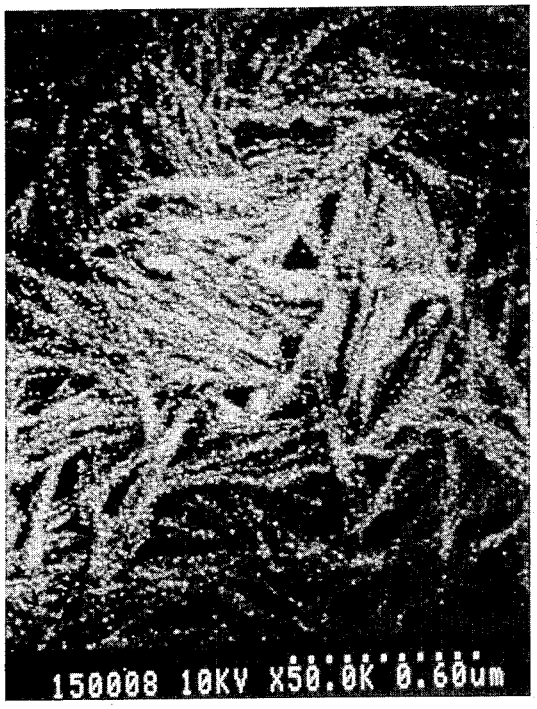
FIG. 1 is an electron photomicrograph of the undercoating layer of Comparative Example 1.
Figure 2:
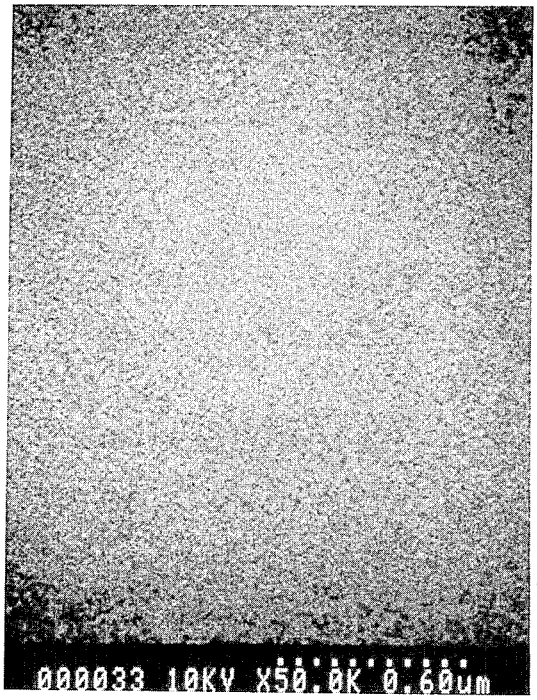
FIG. 2 is an electron photomicrograph of the undercoating layer of Example 1.

An example of a surface having fibril-like and crystalline unevenness, that is an unsmooth surface, is shown in FIG. 1 by means of an electron photomicrograph. On the other hand, an example of a smooth surface shown by an electron photomicrograph is shown in FIG. 2.

In order to make the undercoating layer surface smooth, it is preferable to make an amido group concentration $3.0\times10^{-3}$ equivalent weight/g or less, more preferably $1.0\times10^{-3}$ equivalent weight/g or less, when a polyamide resin is contained in the underocating layer.

Polyamide resins having such a special amido group concentration can be prepared by properly selecting the kind and amount of a dicarboxylic acid, dicarboxylic anhydride, or halogenated dicarboxylic acid, and a diamine and/or aminocarboxylic acid, and the like and conducting polymerization by a conventional method. It is possible to use a commercially available polyamide resin so long as having the amido group concentration as mentioned above.

Even if the composition of a commercially available polyimide is not known (thus the amido group concentration is unknown), the composition can be known by a gas chromatographic analysis after hydrolysis. Thus, it becomes possible to use a polyamide resin having a suitable amido group concentration.

Examples of such commercially available polyamide resins are Torejin MF30, Torejin F30, Torejin EF30T (trade names, mfd. by Teikoku Kagaku Sangyo K.K.), M-1276 (a trade name, mfd. by Nihon Rirusan K.K.), etc.

The polyamide resin contained in the undercoating layer can be used as a single resin or as a mixture of two or more resins.

In the present invention, it is preferable to use a thermosetting resin and a curing agent together with the polyamide resin mentioned above. By the co-use of thermosetting resin and curing agent, the undercoating layer is improved in solvent resistance and film strength, which results in preventing a damage due to a solvent in a solution for forming a photosensitive layer on the undercoating layer.

As the thermosetting resin, there can be used those capable of forming a film under normal states such as melamine resins, benzoquanamine resins, polyurethane resins, epoxy resins, silicone resins, polyester resins, acryl resins, urea resins, and the like. The thermosetting resin can be used in an amount of 300% by weight or less based on the weight of the thermoplastic resin.

As the curing agent, there can be used a carboxylic acid such as trimellitic acid, pyromellitic acid, etc.; an oligomer of amide containing a carboxylic acid. The curing agent can preferably be used in an amount of 20% by weight or less based on the weight of the thermosetting resin.

The undercoating layer in the present invention should have an electric conductivity of at least $2\times10^{-14}\ \Omega^{-1}\cdot cm^{-1}$. When the electric conductivity is less than $2\times10^{-14}\ \Omega^{-1}\cdot cm^{-1}$, there are lowered electrophotographic properties (that is, a residual potential is increased and sensitivity is worsened).

The undercoating layer can be formed by, for example, uniformly dissolving a thermoplastic resin, and if necessary, a thermosetting resin, a curing agent, and the like in a mixed solvent of an alcohol such as methanol, ethanol, isopropanol or the like, and a halogen series solvent such as methylene chloride, 1,1,2-trichloroethane, or the like, coating the resulting solution on the electroconductive substrate by a dip coating method, a spray coating method, a roll coating method, an applicator coating method, a wire bar coating method, etc. and drying the coated layer.

The thickness of undercoating layer is preferably 0.01 μm to 5.0 μm, more preferably 0.05 μm to 20 μm. When the thickness is too small, a uniform charge generating layer cannot be formed and there is a tendency to generate black stains and white stains. On the other hand, when the thickness is too large, accumulation of residual potential becomes large and there is a tendency to lower a printing density with an increase of printing sheets.

The photosensitive layer can be a one-layer photosensitive layer which can perform its function or a function separating type such as a complex type photosensitive layer comprising a charge generating layer mainly having a charge generating function and a charge transport layer mainly having a charge transport function. The photosensitive layer is explained below.

(1) One example of the photosensitive layer comprises a charge generating layer containing one or more organic pigments generating charge and formed thereon a charge transport layer containing one or more charge transport substances.

Examples of the organic pigments generating charge and contained in the charge generating layer are organic pigments of azoxybenzene series, disazo series, trisazo series, benzimidazole series, multiring type quinoline series, indigoid series, quinacridone series, phthalocyanine series, perylene series, methine series, etc., which can generate charge. These pigments are disclosed, for example, in Japanese Patent Unexamined Publication Nos. 47-37543, 47-37544, 47-18543, 47-18544, 48-43942, 48-70538, 49-1231, 49-105536, 50-75214, 50-92738, etc. Considering balance of various electrophotographic properties, the use of phthalocyanine series pigments is preferable. Among the phthalocyanine series pigments, $\tau'$—, $\tau'$—, $\eta$— and $\eta'$—form metal-free phthalocyanines are particularly preferable. Since $\tau$—, $\tau'$—, $\eta$— and $\eta'$—form metal-free phthalocyanine have high sensitivity to longer wavelengths, these compounds are effective for use in an electrophotographic plate for a printer mounting a diode laser. It is also possible to use other organic pigments which can generate charge by irradiation of light.

The amount of organic pigment used in the charge generating layer is preferably 30 to 100% by weight based on the weight of the charge generating layer. When the amount is too small, there is a tendency to lower the sensitivity and to increase the residual potential.

The charge generating layer may contain one or more additives such as binders, plasticizers, fluidity imparting agents, and pin-hole controlling agents depending on purposes.

As the binders, there can be used silicone resins, polyamide resins, polymethane resins, polyester resins, epoxy resins, polycarbonate resins, polystyrene resins, poly(methyl methacrylate) resins, polyacrylamide resins, polybutadiene resins, polyisoprene resins, melamine resins, ethyl cellulose resins, nitro cellulose resins, polychloroprene resins, vinyl acetate resins, polyacrylonitrile resins, urea resins, and the like. It is also possible to use heat and/or light curable resins. In any case, there can be used any resins which can form a film having electric insulating properties under normal state.

As the plasticizers, there can be used halogenated paraffins, dimethylnaphthalene, dibutyl phthalate, etc.

As the fluidity imparting agents, there can be used Modalow (a trade name, mfd. by Monsanto Chemical Co.), Aclonar 4F (a trade name, mfd. by BASF AG), etc.

As the pin-hole controlling agents, there can be used benzoin, dimethyl phthalate, etc.

These additives can preferably be used in amounts of 5% by weight or less, respectively, based on the weight of the organic pigment mentioned above.

As the charge transport substance used in the charge transport layer, there can be used fluorene, fluorenone, 2,7-dinitro-9-fluorenone, 2,4,7-trinitro-9-fluorenone, 4H-indeno(1,2,6)thiophen-4-one, 3,7-dinitro-dibenzothiophene-5-oxide, 1-bromopyrene, 2-phenylpyrene, carbazol, tetra(methoxyphenyl)enamine, 1,1-bis(p-diethylaminophenyl)-4,4-diphenyl-1,3-butadiene, 3-phenylcarbazole, 2-phenylindole, 2-phenylnaphthalene, oxadiazole, oxatriazole, 1-phenyl-3-(4-diethylaminostyryl)-5-(4-diethylaminophenyl)pyrazoline, 2-phenyl-4-(4-diethylaminophenyl)-5-phenyloxazole, triphenylamine, imidazole, chrysene, tetraphene, acridene, poly-N-vinyl carbazole, halogenated poly-N-vinyl carbazole, polyvinyl pyrene, polyvinyl indoloquinoxaline, polyvinyl benzothiophene, polyvinyl anthracene, polyvinyl acridine, polyvinyl pyrazoline, etc., and derivatives of these compounds.

The charge transport layer may contain the same additives such as binders, plasticizers, fluidity imparting agents, pin-hole controlling agents, etc., as used in the charge generating layer. The binder can preferably be used in an amount of 400% by weight or less based on the weight of the charge transport substance so as not to lower electrophotographic properties, or in an amount of 50% by weight or more based on the weight of the charge transport substance in order to maintain coating properties in the case of using a low molecular charge transport substance. The other additives can preferably be used in amounts of 5% by weight or less, respectively, based on the weight of charge transport substance.

(2) Another example of the photosensitive layer is a one-layer containing one or more organic pigments generating charge, or a laminate of a plurality of such a layer. Such a layer may contain one or more charge transport substances.

As the organic pigments generating charge, there can be used those mentioned above (1).

Further, such a layer may contain the same additives such as binders, plasticizers, fluidity imparting agents, pin-hole controlling agents as mention above (1). In addition, as the charge transport substances, the same ones as those mention above (1) can be used.

When a charge transport substance is not used together with the organic pigments which generate charge in the photosensitive layer, it is preferable to use 100 to 900% by weight of the binder, more preferably 200 to 400% by weight, based on the weight of the organic pigments. When the amount of binder is too much, the sensitivity of electrophotographic plate is easily lowered, whereas when the amount of binder is too small, charging characteristics are easily lowered.

In the case of using both the organic pigments generating charge and the charge transport substances in the photosensitive layer, the upper limit of the amount of binder is 450% by weight or less, more preferably 300% by weight or less based on the weight of the charge transport substance. When the amount of binder is too much, the sensitivity of electrophotographic plate is easily lowered. Further, the lower limit of the amount of binder is preferably 80% by weight or more, more preferably 100% by weight or more, based on the weight of the charge transport substance when the charge transport substance is a low molecular compound. In this case, when the amount of binder is too small, the photosensitive layer cannot maintain the strength sufficiently and there is a tendency to lower charging characteristics. In the case of the charge transport substance being a high molecular compound, the lower limit of the binder is preferably 80% by weight or more, more preferably 100% by weight or more, based on the weight of the charge transport substance.

As to the organic pigment generating charge, it is preferable to use it in an amount of 0.1 to 20% by weight, more preferably 0.5 to 5% by weight based on a total weight of the charge transport substance and the binder. When the amount is too small, the sensitivity of electrophotographic plate is lowered. On the other hand, when the amount is too much, there is a tendency to lower the charging characteristics. The other additives can preferably be used in amounts of 0 to 5% by weight, respectively, based on the weight of the photosensitive layer.

In the case of the photosensitive layer of (1) mentioned above, the thickness of the charge generating layer is preferably 0.001 to 10 μm, more preferably 0.2 to 5 μm. The thickness of the charge transport layer is preferably 5 to 50 μm, more preferably 8 to 20 μm. When the thickness of the charge generating layer is less than 0.001 μm, there is a tendency to lower the sensitivity, whereas the thickness is more than 10 μm, there is a tendency to increase the residual potential. Further, when the thickness of the charge transport layer is less than 5 μm, there is a tendency to lower the charging characteristics, whereas the thickness is more than 50 μm, there is a tendency to lower the sensitivity.

In the case of the photosensitive layer of (2) mentioned above, the thickness of the photosensitive layer is preferably 5 to 50 μm, more preferably 8 to 20 μm. When the thickness is less than 5 μm, there is a tendency to lower the charging characteristics, whereas when the thickness is more than 50 μm, there is a tendency to lower the sensitivity.

Individual layers can be formed as follows.

In the case of the photosensitive layer of (1) mentioned above, the charge generating layer containing only organic pigment can be formed by vacuum deposition. When the charge generating layer contains one or more organic pigments, a binder and one or more additives, it can be formed by dissolving or dispersing uniformly these components in a solvent, and coating the resulting solution or dispersion, followed by drying. As the solvent, there can be used acetone, methyl ethyl ketone, tetrahydrofuran, toluene, xylene, methylene chloride, trichloroethane, etc.

In the case of forming the charge transport layer, a charge transport substance, a binder and one or more additives are dissolved in the same solvent as mentioned above in the case of forming the charge generating layer, and coated, followed by drying.

In the case of the photosensitive layer of (2) mentioned above, one or more charge generating materials, and if necessary a charge transport substance, a binder and one or more additives are uniformly dissolved or dispersed in the same solvent as mentioned above in the case of forming the charge generating layer, followed by coating and drying to form the photosensitive layer.

If necessary, a protective layer can be formed on the photosensitive layer by a conventional method. The thickness of the protective layer is preferably 0.01 to 10 μm, more preferably 0.1 to 5 μm. When the thickness is less than 0.01 μm, effects as the protective layer are reduced, and durability becomes poor. On the other hand, when the thickness is more than 10 μm, there is a tendency to lower the sensitivity and to increase the residual potential.

The electrophotographic plate of the present invention can be used for printing according to a conventional process, that is, by conducting charging on the surface, exposing to light, developing, transferring images on plain paper and fixing.

The present invention is illustrated by way of Examples, in which all percents are by weight unless otherwise specified.

In the Examples, the following materials were used.

(1) Organic pigment generating charge τ-form metal-free phthalocyanine (τ-$H_2PC$) [mfd. by Toyo Ink Mfg. Co., Ltd.]

(2) Charge transport substance (a) Hydrazone derivative: p-Dimethylamino-(o-ethoxy)benzaldehyde phenyl hydrazone (HYZ) of the formula:

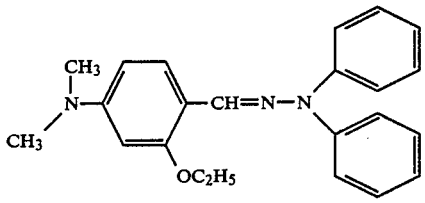

(b) Butadiene derivative: 1,1-Bis(p-diethylamino-phenyl)-4,4-diphenyl-1,3-butadiene (PBD) of the formula:

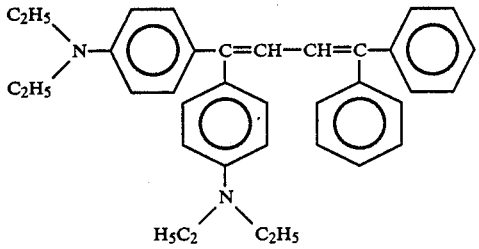

(3) Binder (A) Undercoating layer:

(i) Polyamide resin: CM 8000 (solid content 100%), amido group concentration: $7.72\times10^{-3}$ eq. wt./g [mfd. by Toray Industries, Inc.]

(ii) Polyamide resin: M 995 (solid content 100%), amido group concentration: $7.20\times10^{-3}$ eq. wt./g [mfd. by Nihon Rirusan K.K.]

(iii) Polyamide resin: MX 1809 (solid content 100%), amido group concentration: 0 eq. wt./g [mfd. by Nihon Rirusan K.K.]P1 (iv) Polyamide resin: M 1276 (solid content 100%), amido group concentration: $6.85\times10^{-4}$ eq. wt./g [mfd. by Nihon Rirusan K.K.]

(v) Polyamide resin: Toresin EF-30T (solid content 100%), amido group concentration: $2.59\times10^{-3}$ eq. wt./g [mfd. by Teikoku Kagaku Sangyo K.K.]

(vi) Melamine resin: Melan 2000 (M 2000) (solid content 50%) [mfd. by Hitachi Chemical Co., Ltd.]

(vii) Phenol resin: Hitanol 2420 (PR 2420) (solid content 100%) [mfd. by Hitachi Chemical Co., Ltd.]

(B) Charge generating layer:

(i) Silicone varnish: KR 214 (solid content 70%) [mfd. by Shin-etsu Chemical Industry Co., Ltd.]

(C) Charge transport layer:

(i) Polycarbonate resin: Iupilon S-3000 (UP 3000) (solid content 100%) [mfd. by Mitsubishi Gas-Chemical Co., Inc.]

EXAMPLE 1

A polyamide resin (M 1276) in an amount of 5 g was completely dissolved in 95 g of a 1:1 (by weight) mixed solvent of methanol and methylene chloride. The resulting solution was coated on an aluminum plate (an electroconductive substrate of 0.1 mm thick) using an applicator and dried at 100° C. for 10 minutes to give an undercoating layer of 0.3 μm thick. The surface of the undercoating layer was observed using a scanning electron microscope (S-800, a trade name, mfd. by Hitachi, Ltd.) with the magnification of 50,000. No fibril-like crystalline unevenness was observed on the surface. The surface state was taken by an electron photomicrograph and shown in FIG. 2. A volume resistivity of the undercoating layer was measured by using a High Resistance Meter YHP 4329 (a trade name, mfd. by Yokogawa Hewlett Packard K.K.). The volume resistivity was $9.3\times10^{12}$ Ωcm, which value was calculated as $1.08\times10^{-13}$ $\Omega^{-1}\cdot cm^{-1}$ in an electric conductivity.

Then, a mixed liquid of 2.5 g of τ-form metal-free phthalocyanine (τ-$H_2PC$), 2.5 g of a silicone varnish (KR 214) and 95 g of tetrahydrofuran (THF) was kneaded for 8 hours in a ball mill (a 10-cm diameter pot mill mfd. by Nippon Kagaku Togyo Co., Ltd.). The resulting dispersion was coated on the undercoating layer using an applicator and dried at 100° C. for 30 minutes to form a charge generating layer of 0.5 μm thick.

Then, 5 g of a charge transport substance (HYZ) and 5 g of a polycarbonate resin (UP 3000) were completely dissolved in 90 g of a 1:1 (by weight) mixed solvent of methylene chloride and 1,1,2-trichloroethane. The resulting solution was coated on the charge generating layer using an applicator and dried at 120° C. for 20 minutes to form a charge transport layer of 18 μm thick. Thus, an electrophotographic plate was produced.

COMPARATIVE EXAMPLE 1

A polyamide resin (CM 8000) in an amount of 5 g was completely dissolved in 95 g of a 1:1 (by weight) mixed solvent of methanol and methylene chloride. The resulting solution was coated on an aluminum plate (an electroconductive substrate of 0.1 mm thick) using an applicator and dried at 100° C. for 10 minutes to give an undercoating layer of 0.5 μm in thickness. The surface of the undercoating layer was observed using a scanning type electron microscope (S-800, a trade name, mfd. by Hitachi, Ltd.) with the magnification of 50,000. Fibril-like crystalline unevenness was observed on the surface. The surface state was taken by an electron photomicrograph and shown in FIG. 1. A volume resistivity of the undercoating layer was measured by using a high resistance meter YHP 4329 (a trade name, mfd. by Yokogawa Hewlett Packard K.K.). The volume resistivity was $5.4\times10^{11}$ Ω·cm. Thus, the electric conductivity was calculated as $1.85\times10^{-12}$ $\Omega^{-1}\cdot cm^{-1}$.

Then, a mixed liquid of 2.5 g of τ-$H_2PC$, 2.5 g of a silicone varnish (KR 214) and 95 g of tetrahydrofuran (THF) was kneaded for 8 hours in a ball mill (a 10-cm diameter pot will mfd. by Nippon Kagaku Togyo Co., Ltd.). The resulting dispersion was coated on the undercoating layer using an applicator and dried at 100° C. for 30 minutes to form a charge generating layer of 0.5 μm thick.

Then, 5 g of a charge transport substance (HYZ) and 5 g of a polycarbonate resin (UP 3000) were completely dissolved in 90 g of a 1:1 (by weight) mixed solvent of methylene chloride and 1,1,2-trichloroethane. The resulting solution was coated on the charge generating layer using an applicator and dried at 120° C. for 20 minutes to form a charge transport layer of 18 μm thick. Thus, an electrophotographic plate was produced.

COMPARATIVE EXAMPLE 2

A polyamide resin (M 995) in an amount of 5 g was completely dissolved in 95 g of a 1:1 (by weight) mixed solvent of methanol and methylene chloride. The resulting solution was coated on an aluminum plate (an electroconductive substrate of 0.1 mm thick) using an applicator and dried at 90° C. for 10 minutes to give an undercoating layer of 0.2 μm thick. The surface of the undercoating layer was observed using the scanning electron microscope (magnification 50,000). As a result, fibril-like crystalline unevenness was observed on the surface. The volume resistivity of the undercoating layer was measured as $3.6\times10^{13}$ Ω·cm, which value was calculated as $2.78\times10^{-14}$ $\Omega^{-1}\cdot cm^{-1}$ in the electric conductivity.

A charge generating layer of 0.5 μm thick was coated on the undercoating layer in the same manner as described in Comparative Example 1.

Then, 5 g of a charge transport substance (PBD) and 5 g of a polycarbonate resin (UP 3000) were completely dissolved in 90 g of a 1:1 (by weight) mixed solvent of methylene chloride and 1,1,2-trichloroethane. The resulting solution was coated on the charge generating layer using an applicator and dried at 120° C. for 20 minutes to form a charge transport layer of 16 μm thick. Thus, an electrophotographic plate was produced.

COMPARATIVE EXAMPLE 3

A polyamide resin (MX 1809) in an amount of 8 g was completely dissolved in 92 g of a 1:1 (by weight) mixed solvent of methanol and methylene chloride. The resulting solution was coated on an aluminum plate (an electroconductive substrate of 0.1 mm thick) using an applicator and dried at 100° C. for 10 minutes to form an undercoating layer of 0.6 μm thick. The surface of the undercoating layer was observed by using the scanning electron microscope with the magnification of 50,000. No fibril-like crystalline unevenness was observed. The volume resistivity was measured as $1.8\times10^{15}$ Ω·cm, which value was calculated as $5.56\times10^{-15}$ $\Omega^{-1}\cdot cm^{-1}$ in the electric conductivity.

A charge generating layer of 0.2 μm thick was formed on the undercoating layer in the same manner as described in Comparative Example 1.

A charge transport layer of 16 μm thick was formed on the charge generating layer in the same manner as described in Comparative Example 1. Thus, an electrophotographic plate was produced.

COMPARATIVE EXAMPLE 4

A polyamide resin (M 995) in an amount of 2.5 g, 2.5 g of a melamine resin (M 2000) and 0.20 g of trimellitic acid were completely dissolved in 95 g of a 1:1 (by weight) mixed solvent of methanol and methylene chloride. The resulting solution was coated on an aluminum plate (an electroconductive substrate of 0.1 mm thick) using an applicator and dried at 110° C. for 10 minutes to form an undercoating layer of 0.2 μm thick. The surface of the undercoating layer was observed by using the scanning electron microscope with the magnification of 50,000. As a result, fibril-like crystalline unevenness was observed on the surface. The volume resistivity of the undercoating layer was measured as $2.3\times10^{13}$ Ωcm, which value was calculated as $4.35\times10^{-14}$ $\Omega^{-1}\cdot cm^{-1}$ in the electric conductivity.

A charge generating layer of 0.5 μm thick was formed on the undercoating layer in the same manner as described in Comparative Example 1.

A charge transport layer of 16 μm thick was formed on the charge generating layer in the same manner as described in Comparative Example 2. Thus, an electrophotographic plate was produced.

EXAMPLE 2

A polyamide resin (M 1276) in an amount of 1.5 g, 3.5 g of a melamine resin (M 2000) and 0.35 g of trimellitic acid were completely dissolved in 95 g of a 1:1 (by weight) mixed solvent of methanol and methylene chloride. The resulting solution was coated on an aluminum plate (an electroconductive substrate of 1 mm thick) using an applicator and dried at 110° C. for 10 minutes to form an undercoating layer of 0.5 μm thick. The surface of the undercoating layer was observed by using the scanning electron microscope with the magnification of 50,000. No fibril-like crystalline unevenness was observed on the surface. The volume resistivity of the undercoating layer was measured as $3.8\times10^{12}$ Ωcm, which value was calculated as $2.63\times10^{-13}$ $\Omega^{-1}\cdot cm^{-1}$ in the electric conductivity.

A charge generating layer of 0.4 μm thick was formed on the undercoating layer in the same manner as described in Example 1.

A charge transport layer of 16 μm thick was formed on the charge generating layer in the same manner as described in Comparative Example 2. Thus, an electrophotographic plate was produced.

EXAMPLE 3

A polyamide resin (M 1276) in an amount of 1.5 g, 3.5 g of a phenol resin (PR 2420), and 0.35 g of trimellitic acid were completely dissolved in 95 g of a 1:1 (by weight) mixed solvent of methanol and methylene chloride. The resulting solution was coated on an aluminum plate (an electroconductive substrate of 0.1 mm thick) using an applicator and dried at 120° C. for 10 minutes to form an undercoating layer of 0.3 μm thick. The surface of the undercoating layer was observed by using the scanning electron microscope with the magnification of 50,000. No fibril-like crystalline unevenness was observed on the surface. The volume resistivity of the undercoating layer was measured as $4.6\times10^{13}$ Ωcm, which value was calculated as $2.17\times10^{-14}$ $\Omega^{-1}\cdot cm^{-1}$ in the electric conductivity.

A charge generating layer of 0.5 μm thick was formed on the undercoating layer in the same manner as described in Example 1.

A charge transport layer of 15 μm thick was formed on the charge generating layer in the same manner as described in Comparative Example 2. Thus, an electrophotographic plate was produced.

EXAMPLE 4

A polyamide resin (EF-30T) in an amount of 5 g was completely dissolved in 95 g of a 1:1 (by weight) mixed solvent of methanol and methylene chloride. The resulting solution was coated on an aluminum plate (an electroconductive substrate of 0.1 mm thick) using an applicator and dried at 100° C. for 10 minutes to form an undercoating layer of 0.4 μm thick. The surface of the undercoating layer was observed by using the scanning electron microscope with the magnification of 50,000. No fibril-like crystalline unevenness was observed on the surface. The volume resistivity of the undercoating layer was measured as $1.93\times10^{11}$ Ωcm, which value was calculated as $5.16\times10^{-12}\ \Omega^{-1}\cdot cm^{-1}$ in the electric conductivity.

A charge generating layer of 0.5 μm thick was formed on the undercoating layer in the same manner as described in Example 1.

A charge transport layer of 18 μm thick was formed on the charge generating layer in the same manner as described in Example 1. Thus, an electrophotographic plate was produced.

EXAMPLE 5

A melmmine resin (M 2000) in an amount of 5 g and 1 g of pyromellitic acid were completely dissolved in 94 g of a 1:1 (be weight) mixed solvent of methanol and methylene chloride. The resulting solution was coated on an aluminum plate (an electroconductive substrate of 0.1 mm thick) using an applicator and dried at 120° C. for 10 minutes to form an undercoating layer of 0.5 μm thick. The surface of the undercoating layer was observed by using the scanning electron microscope with the magnification of 50,000. No fibril-like crystalline unevenness was observed on the surface. The volume resistivity of the undercoating layer was measured as $8.6\times10^{12}$ Ωcm, which value was calculated as $1.16\times10^{-13}\ \Omega^{-1}\cdot cm^{-1}$ in the electric conductivity.

A charge generating layer of 0.6 μm thick was formed on the undercoating layer in the same manner as described in Example 1.

A charge transport layer of 18 μm thick was formed on the charge generating layer in the same manner as described in Example 1. Thus, an electrophotographic plate was produced.

The electrophotographic plates obtained in Examples 1 to 5 and Comparative Examples 1 to 4 were subjected to measurement of electrophotographic properties (23° C.) using an electrostatic recording paper analyzer (SP-428, mfd. by Kawaguchi Electric Works Co., Ltd.). The results are shown in Table 1.

In Table 1, the potential Vo(−v) is a charge potential at a corona discharge of −5 kV for 15 seconds in the dynamic measurement. The dark decay (Vk) is a potential retention rate $[(V_{30}/V_0)\times100\%]$ wherein $V_{30}$ is a potential after allowed to stand for 30 seconds in the dark. The half decay exposure amount ($E_{50}$) is a light amount necessary for making the potential a half when exposed to a white light. The residual potential ($V_R$) is a surface potential after exposed to a white light of 10 lux for 30 seconds.

Further, the electrophotographic plates of Examples 1 to 5 and Comparative Examples 1 to 4 were subjected to evaluation of image quality using an image evaluating device (reverse development). The evaluation was conducted by the following three methods:

① An electrophotographic plate was allowed to stand under circumstances of 23° C. and relative humidity of 60% (23° C., 60% RH) for 2 hours, followed by the evaluation under the same circumstances.

② An electrophotographic plate was allowed to stand under circumstances of 35° C. and relative humidity of 60% (35° C., 60% RH) for 2 hours, followed by the evaluation under the same circumstances.

③ An electrophotographic plate was allowed to stand under circumstances of 40° C. and relative humidity of 80% (40° C., 80% RH) for 2 hours, allowed to stand at 23° C. and a relative humidity of 60%, followed by the evaluation under the same circumstances.

The results are shown in Table 1.

TABLE 1

| | Undercoating layer | | | | | |
|---|---|---|---|---|---|---|
| | Binder | | | | Film | |
| Example No. | Thermoplastic resin | Amido group concentration (eq. wt./g) | Thermosetting resin | Curing agent | thickness (μm) | Smoothness *1 |
| Comparative Example 1 | CM 8000 | $7.72\times10^{-3}$ | — | — | 0.5 | X |
| Comparative Example 2 | M 995 | $7.20\times10^{-3}$ | — | — | 0.2 | X |
| Comparative Example 3 | MX 1809 | 0 | — | — | 0.6 | ○ |
| Comparative Example 4 | M 995 | $7.20\times10^{-3}$ | M 2000 | Trimellitic acid | 0.2 | X |
| Example 1 | M 1276 | $6.85\times10^{-4}$ | — | — | 0.3 | ○ |
| Example 2 | M 1276 | $6.85\times10^{-4}$ | M 2000 | Trimellitic acid | 0.5 | ○ |
| Example 3 | M 1276 | $6.85\times10^{-4}$ | PR 2420 | Trimellitic acid | 0.3 | ○ |
| Example 4 | EF 30T | $2.59\times10^{-3}$ | M 2000 | Trimellitic acid | 0.4 | ○ |
| Example 5 | — | — | M 2000 | Pyromellitic acid | 0.5 | ○ |

| | Undercoating layer | Electrophotographic properties (23° C.) | | | | Image quality *2 | | |
|---|---|---|---|---|---|---|---|---|
| | Electric | | | | | ① | ② | ③ |
| Example No. | conductivity ($\Omega^{-1}\cdot cm^{-1}$) | $V_0$ (−v) | $V_K$ (%) | $E_{50}$ (lx · s) | $V_R$ (−v) | 23° C., 60% RH | 35° C., 60% RH | 40° C., 80% RH after 72 hrs |
| Comparative Example 1 | $1.85\times10^{-12}$ | 1150 | 86 | 2.4 | 5 | Good | No good (Black stains) | No good (Black stains) |
| Comparative | $2.78\times10^{-14}$ | 1250 | 88 | 1.8 | 5 | Good | No good | No good |

TABLE 1-continued

| | | | | | | | | |
|---|---|---|---|---|---|---|---|---|
| Example 2 | | | | | | | (Black stains) | (Black stains) |
| Comparative Example 3 | $5.56 \times 10^{-15}$ | 1210 | 90 | 5.2 | 50 | No good (Low density) | No good (Low density) | No good (Low density) |
| Comparative Example 4 | $4.35 \times 10^{-14}$ | 1180 | 85 | 2.0 | 10 | Good | No good (Black stains) | No good (Black stains) |
| Example 1 | $1.08 \times 10^{-13}$ | 1150 | 88 | 2.3 | 5 | Good | Good | Good |
| Example 2 | $2.63 \times 10^{-13}$ | 1180 | 88 | 1.8 | 0 | Good | Good | Good |
| Example 3 | $2.17 \times 10^{-14}$ | 1250 | 90 | 1.6 | 0 | Good | Good | Good |
| Example 4 | $5.16 \times 10^{-12}$ | 1200 | 88 | 1.7 | 0 | Good | Good | Good |
| Example 5 | $1.16 \times 10^{-13}$ | 1230 | 89 | 2.0 | 3 | Good | Good | Almost good (slight black stains) |

As shown in Table 1, the undercoating layers of Comparative Examples 1, 2 and 4 are not good in the smoothness (fibril-like crystalline unevenness was observed). The electrophotographic plates of Comparative Examples 1, 2 and 4 are good in the electrophotographic properties (23° C.) and good in the image quality evaluated by the method ①, but not good when evaluated by the methods ② and ③, since black stains were generated on the whole surface of white background. On the other hand, in Comparative Example 3, the undercoating layer has an electric conductivity of $5.56\times10^{-5}\ \Omega^{-1}\cdot cm^{-1}$ and is good in the smoothness. But the image quality evaluated by the methods ①, ② and ③ are not good because the image density is lowered remarkably due to lowering in the electrophotographic properties (23° C.), that is, $E_{50}$ and $V_R$ are increased remarkably, although no black stains are generated.

In contrast, in Examples 1 to 5, the undercoating layers are smooth and have the electric conductivity of $2\times10^{-14}\ \Omega^{-1}\cdot cm^{-1}$ or more. The electrophotographic plate of Examples 1 to 5 are good in the electrophotographic properties (23° C.) and also good in the image quality evaluated by the methods ①, ② and ③, that is, the printed letter quality is changed by the changes of circumstances.

What is claimed is:

1. An electrophotographic plate comprising an electroconductive substrate, an undercoating layer formed on the substrate, and a photosensitive layer formed on the undercoating layer, said undercoating layer having a smooth surface when observed by a scanning electron microscope and an electric conductivity of at least $2\times10^{-14}\ \Omega^{-1}\cdot cm^{-1}$; said undercoating layer containing a polyamide resin which has an amido group concentration of $3.0\times10^{-3}$ equivalent weight/g or less.

2. An electrophotographic plate according to claim 1, wherein the undercoating layer contains a polyamide resin, a thermosetting resin and a curing agent.

3. An electrophotographic plate according to claim 2 wherein the thermosetting resin is a melamine resin or a phenol resin and the curing agent is trimellitic acid.

4. An electrophotographic plate according to claim 1, wherein the undercoating layer has a smooth surface without showing fibril-like and crystalline unevenness when observed by using a scanning electron microscope.

5. An electrophotographic plate according to claim 1, wherein the polyamide resin is soluble in a mixed solvent of an alcohol and a halogen-containing solvent.

6. An electrophotographic plate according to claim 1, wherein the undercoating layer further comprises a thermoplastic resin selected from the group consisting of polyvinyl butyral resins, ethylene-vinyl acetate copolymer resins, ethylene-acrylic acid copolymer resins and casein.

7. An electrophotographic plate according to claim 2, wherein the thermosetting resin is a melamine resin, a benzoguanamine resin, a polyurethane resin, an epoxy resin, a silicon resin, a polyester resin, an acryl resin, or a urea resin.

* * * * *